US008054231B2

(12) United States Patent
Ahn et al.

(10) Patent No.: US 8,054,231 B2
(45) Date of Patent: Nov. 8, 2011

(54) MOBILE TERMINAL HAVING METAL CASE AND ANTENNA STRUCTURE

(75) Inventors: Jung Ho Ahn, Seoul (KR); Yong Jin Kim, Seoul (KR); Dong Hwan Kim, Hwaseong-si (KR); Jae Ho Lee, Yongin-si (KR); Seung Hwan Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 312 days.

(21) Appl. No.: 12/419,503

(22) Filed: Apr. 7, 2009

(65) Prior Publication Data

US 2009/0278757 A1 Nov. 12, 2009

(30) Foreign Application Priority Data

May 6, 2008 (KR) ..... 10-2008-0041704

(51) Int. Cl.
*H01Q 1/24* (2006.01)
*H01Q 13/10* (2006.01)

(52) U.S. Cl. ..... 343/702; 343/770

(58) Field of Classification Search ..... 343/702, 343/767, 770, 872
See application file for complete search history.

(56) References Cited

U.S. PATENT DOCUMENTS

2009/0153412 A1* 6/2009 Chiang et al. ..... 343/702
2009/0231215 A1* 9/2009 Taura ..... 343/702

FOREIGN PATENT DOCUMENTS

WO 2007/058230 A1 5/2007

* cited by examiner

*Primary Examiner* — Hoang V Nguyen
(74) *Attorney, Agent, or Firm* — Jefferson IP Law, LLP

(57) ABSTRACT

A mobile terminal including a metal case and an antenna structure that can exhibit optimum radiation performance is provided. The antenna structure includes an antenna having a radiation unit for transmitting and for receiving electric waves, a Printed Circuit Board (PCB) to which the antenna is mechanically coupled at one surface thereof and having a power supply unit electrically coupled to the radiation unit, and a case constructed using a metal material within which the PCB is disposed, wherein the case has at least one slot formed in a surface thereof opposite to the surface to which the PCB is fastened and adjacent to the radiation unit.

15 Claims, 12 Drawing Sheets

FIG .5B

| Frequency | Eff. (%) | Ave. Gain (dBi) | Peak Gain (dBi) | Directivity (dBi) |
|---|---|---|---|---|
| 824 MHz | 10 | -9.90 | -3.91 | 5.99 |
| 837 MHz | 11 | -9.70 | -4.15 | 5.55 |
| 849 MHz | 15 | -8.20 | -3.37 | 4.83 |
| 869 MHz | 19 | -7.30 | -3.17 | 4.13 |
| 881 MHz | 10 | -9.94 | -4.07 | 5.87 |
| 894 MHz | 12 | -9.30 | -4.74 | 4.56 |
| 1850 MHz | 35 | -4.51 | -1.41 | 3.10 |
| 1880 MHz | 35 | -4.55 | -1.72 | 2.83 |
| 1910 MHz | 32 | -4.94 | -1.44 | 3.50 |
| 1930 MHz | 26 | -5.81 | -2.71 | 3.10 |
| 1960 MHz | 24 | -6.21 | -2.92 | 3.29 |
| 1990 MHz | 25 | -5.94 | -2.40 | 3.54 |

FIG .7B

| Frequency | Eff. (%) | Ave. Gain (dBi) | Peak Gain (dBi) | Directivity (dBi) |
|---|---|---|---|---|
| 824 MHz | 11 | -9.60 | -3.87 | 5.73 |
| 849 MHz | 15 | -8.30 | -3.85 | 4.45 |
| 869 MHz | 18 | -7.37 | -2.33 | 5.04 |
| 894 MHz | 14 | -8.55 | -3.90 | 4.65 |
| 1850 MHz | 23 | -6.29 | -0.50 | 5.79 |
| 1910 MHz | 25 | -5.97 | -1.77 | 4.20 |
| 1930 MHz | 30 | -5.30 | -1.03 | 4.27 |
| 1990 MHz | 36 | -4.38 | -0.82 | 3.56 |

FIG .8B

| Frequency | Eff. (%) | Ave. Gain (dBi) | Peak Gain (dBi) | Directivity (dBi) |
|---|---|---|---|---|
| 1574 MHz | 31 | -5.06 | -2.19 | 2.87 |
| 1574.4 MHz | 31 | -5.07 | -2.20 | 2.87 |
| 1574.8 MHz | 31 | -5.10 | -2.23 | 2.87 |
| 1575.2 MHz | 31 | -5.08 | -2.13 | 2.95 |
| 1575.6 MHz | 31 | -5.05 | -2.12 | 2.93 |
| 1576 MHz | 31 | -5.04 | -2.14 | 2.90 |

MOBILE TERMINAL HAVING METAL CASE AND ANTENNA STRUCTURE

PRIORITY

This application claims the benefit under 35 U.S.C. §119 (a) of a Korean patent application filed in the Korean Intellectual Property Office on May 6, 2008 and assigned Serial No. 10-2008-0041704, the entire disclosure of which is hereby incorporated by reference.

BACKGROUND OF THE INVENTION

1. Field of the Invention

The present invention relates to a mobile terminal. More particularly, the present invention relates to a mobile terminal having a metal case and an antenna structure that may exhibit optimum radiation performance.

2. Description of the Related Art

A mobile terminal is a terminal that can perform various functions using wireless communication and various application programs while being transported, such as a personal mobile communication services terminal, Personal Digital Assistant (PDA), smart phone, International Mobile Telecommunication 2000 (IMT-2000) terminal and wireless Local Area Network (LAN) terminal.

Due to continuous improvements, the mobile terminal has a small size, is light weight and has various functions, such as Moving Picture Experts Group layer-3 (MP3), digital camera, navigation and Internet connection. Accordingly, the mobile terminal is used as a complex communication terminal.

As the mobile terminal continuously develops, consumers request a mobile terminal of various designs. Thus, various materials are used for the mobile terminal.

Presently, various research for using a metal material as a case of the mobile terminal has been carried out. However, when using metal as the case of the mobile terminal, the metal case operates as an element that disturbs signal radiation from the antenna. Thus, the antenna function of the mobile terminal is deteriorated.

Therefore, a need exists for an antenna in a mobile terminal that sustains performance when a case of the mobile terminal is a metal material.

SUMMARY OF THE INVENTION

An aspect of the present invention is to address at least the above-mentioned problems and/or disadvantages and to provide at least the advantages described below. Accordingly, an aspect of the present invention is to provide a mobile terminal and an antenna structure thereof that have a metal case in which radiation performance of an antenna may be sustained.

In accordance with an aspect of the present invention, an antenna structure is provided. The antenna structure includes an antenna having a radiation unit for transmitting and for receiving electric waves, a Printed Circuit Board (PCB) to which the antenna is mechanically coupled at one surface thereof and having a power supply unit electrically coupled to the radiation unit, and a case constructed using a metal material within which the PCB is disposed, wherein the case has at least one slot formed in a surface thereof opposite to the surface to which the PCB is mechanically coupled and adjacent to the radiation unit.

In accordance with another aspect of the present invention, a mobile terminal is provided. The mobile terminal includes an antenna having a radiation unit for transmitting and for receiving electric waves, a PCB to which the antenna is mechanically coupled at one surface thereof and having a power supply unit electrically coupled to the radiation unit, and a case constructed using a metal material within which the PCB is disposed, wherein the case has at least one slot formed in a surface thereof opposite to the surface to which the PCB is mechanically coupled and adjacent to the radiation unit.

Other aspects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings, in which:

FIG. 5B is a table illustrating a passive gain on a frequency basis according to a measured result of a VSWR of a mobile terminal according to an exemplary embodiment of the present invention;

FIG. 7B is a table illustrating a passive gain on a frequency basis according to a measured result of a VSWR of a mobile terminal according to an exemplary embodiment of the present invention;

FIG. 8B is a table illustrating a passive gain on a frequency basis according to a measured result of a VSWR of a mobile terminal having a GPS antenna according to an exemplary embodiment of the present invention.

Throughout the drawing, it should be noted that like reference numbers are used to depict the same or similar elements, features and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

Figure 1A:
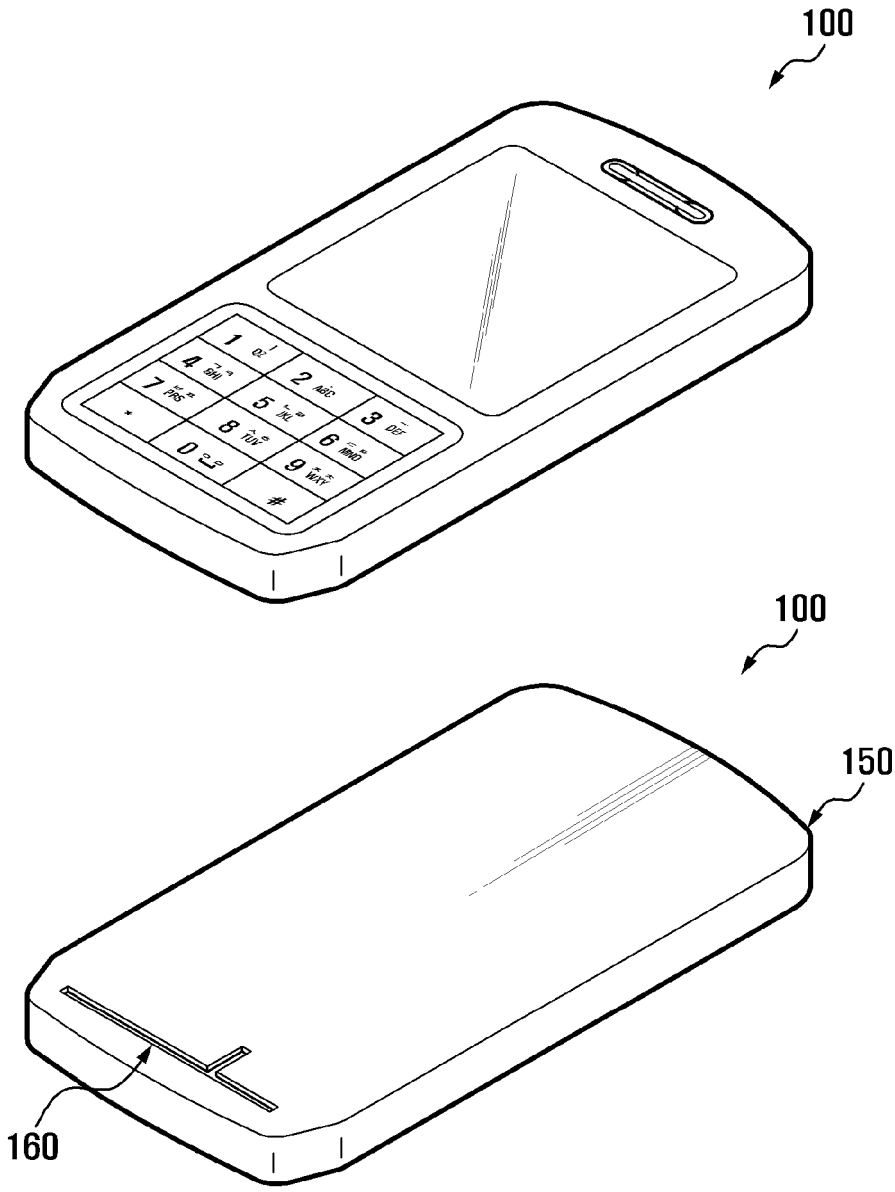
FIG. 1A is a perspective view illustrating a mobile terminal according to an exemplary embodiment of the present invention.
Figure 1B:
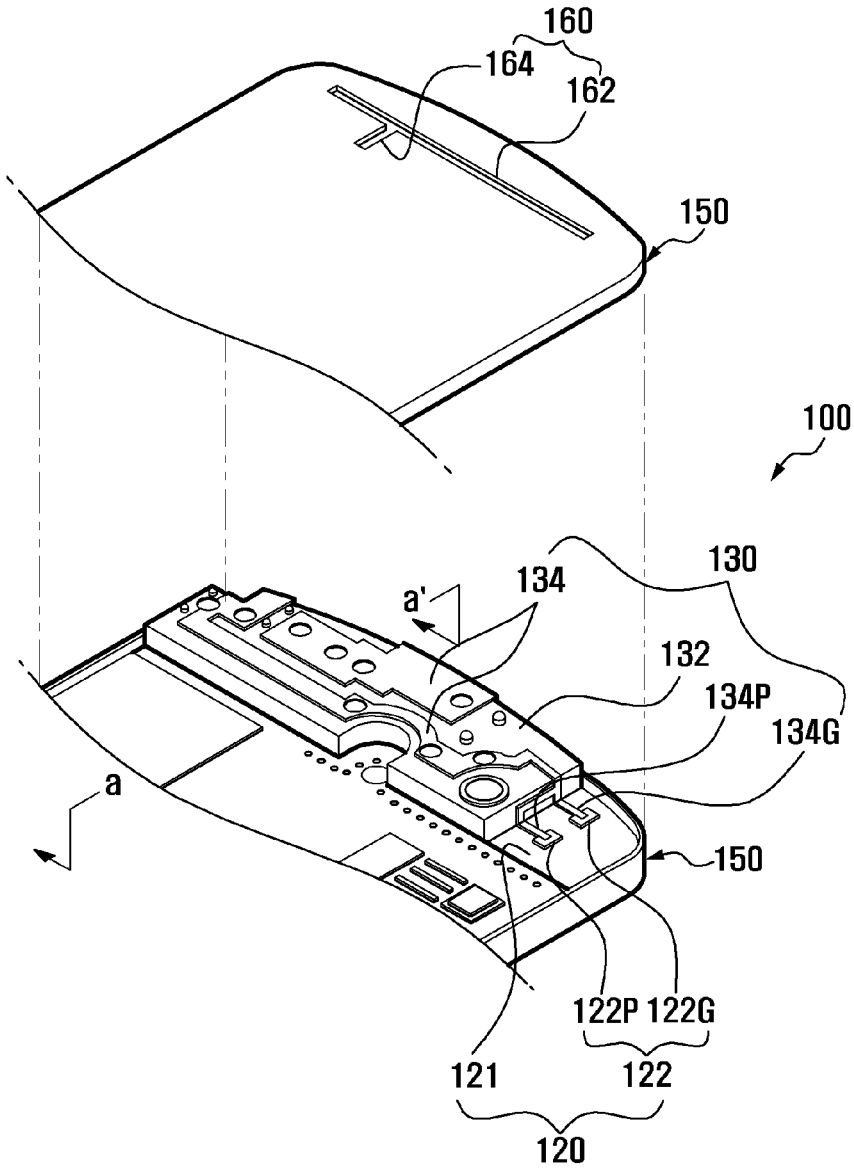
FIG. 1B is an exploded perspective view of an antenna portion of the mobile terminal of FIG. 1A according to an exemplary embodiment of the present invention.
Figure 1C:
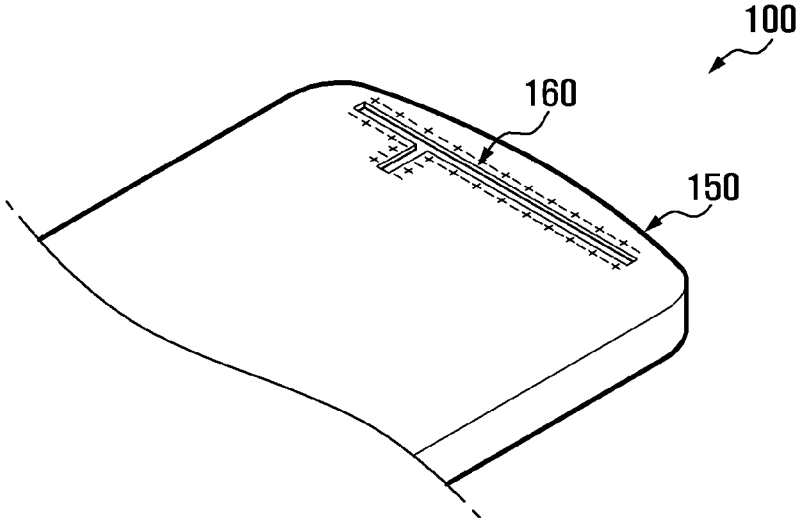
FIG. 1C is a partial perspective view illustrating electric charges induced in a slot of a case of the mobile terminal of FIG. 1A according to an exemplary embodiment of the present invention.
Figure 2:
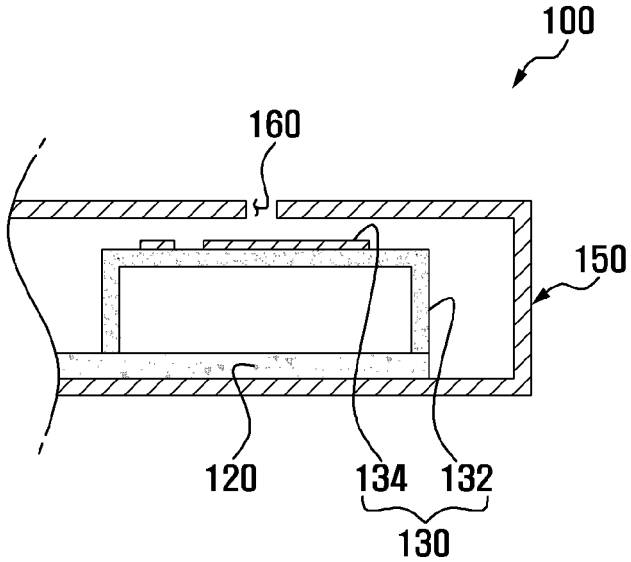
FIG. 2 is a cross-sectional view of the antenna portion of FIG. 1B according to an exemplary embodiment of the present invention.

FIG. 1A is a perspective view illustrating a mobile terminal according to an exemplary embodiment of the present invention, FIG. 1B is an exploded perspective view of an antenna portion of the mobile terminal of FIG. 1A according to an exemplary embodiment of the present invention, and FIG. 1C is a partial perspective view illustrating electric charges induced in a slot of a case of the mobile terminal of FIG. 1A according to an exemplary embodiment of the present invention. FIG. 2 is a cross-sectional view of the antenna portion of FIG. 1B according to an exemplary embodiment of the present invention.

Referring to FIGS. 1A to 1C and 2, a mobile terminal 100 according to an exemplary embodiment of the present invention includes an antenna 130, PCB 120, and case 150.

The antenna 130 is an embedded type antenna provided within the mobile terminal 100 and fastened to one surface of the PCB 120. The antenna 130 includes a base 132, made of an insulation material and a radiation unit 134 formed in an upper surface of the base 132 to transmit and to receive electric waves.

The antenna 130 is an antenna for transmitting and for receiving communication and may be one of a Code Division Multiple Access (CDMA) antenna, a Personal Communication Service (PCS) antenna and a Global System for Mobile (GSM) Communication antenna. However, the antenna 130 is not limited thereto. The antenna 130 may be any antenna that can wirelessly transmit and receive electric waves, such as a Global Positioning System (GPS) antenna, Bluetooth antenna and wireless Local Area Network (LAN) antenna.

The base 132 is used for separating the radiation unit 134 from the PCB 120 by a certain distance. The base 132 is formed with a recess in its lower surface such that the base 132 has a hollow form and contacts with the PCB 120 at the lower edges of the base 132. However, the base 132 is not limited thereto and may be embodied in various forms, such as a completely enclosed hollow form and a solid form.

The radiation unit 134 may have various shapes according to a frequency. A power supply pin 134P and a ground pin 134G connected to the PCB 120 are formed at one end of the radiation unit 134 thereof. The power supply pin 134P and the ground pin 134G are electrically connected to a power supply pad 122P and a ground pad 122G, respectively, of the PCB 120.

The PCB 120 is any board that may be mounted inside the mobile terminal 100, such as a PCB or a Printed Board Assembly (PBA). The PCB 120 includes a board body 121 and a power supply unit 122 formed at a surface of the board body 121.

The board body 121 is an insulation plate having a certain thickness, on which various elements for operating the mobile terminal 100 are mounted and wiring for electrically connecting the elements is formed. Prepreg, glass-epoxy resin comprising glass fiber, and Bismaleimide-Triazine (BT) resin may be used as a material of the board body 121.

The power supply unit 122 includes the power supply pad 122P electrically connected to the power supply pin 134P of the radiation unit 134 and the ground pad 122G electrically connected to the ground pin 134G of the radiation unit 134. Although not illustrated, at least one of the power supply pad 122P and the ground pad 122G may be electrically connected to a ground layer (not illustrated) formed in other circuits or to the board body 121. Each of the components of the power supply unit 122 may be a wiring layer made of copper and may be formed by patterning with a photolithography process after attaching a copper foil to the board body 121.

In an exemplary implementation, the power supply unit 122 is formed at the same surface of the board body 121 as the surface to which the antenna 130 is fastened. However, in another exemplary implementation, the power supply unit 122 may be formed at another surface of the PCB 120.

Further, as described above, in the PCB 120 of the mobile terminal 100, various wirings are formed in addition to the power supply unit 122 and various elements are mounted thereto. Since the wirings and elements are not relevant for describing the antenna structure according to an exemplary embodiment of the present invention, a description thereof is omitted.

The case 150 forms an external shape of the mobile terminal 100. The case 150 is fastened to the PCB 120 to which the antenna 130 is fastened and protects internal components from an external impact. Further, the case 150 is entirely made of a metal material. The metal material of the case 150 is not limited to a specific metal.

The case 150 has at least one slot 160 formed in a surface of the case 150 opposite to the surface to which the PCB 120 is fastened and at a position adjacent to the radiation unit 134. Further, the radiation unit 134 is separated from the surface of the case 150 in which the slot 160 is formed by a certain distance, the separation distance being set to a distance (for example, about 1 mm) for enabling a coupling effect between the radiation unit 134 and an area of the case 150 opposite thereto in which the slot 160 is formed ('slot area').

The slot 160 includes a first slot 162 which may be formed as a straight line along a length direction of the radiation unit 134 and a second slot 164 which may be formed as a straight line along a width direction of the radiation unit 134 and having one end connected to the first slot 162. In an exemplary implementation, the first slot 162 and the second slot 164 each have a width of about 1 mm, however the width thereof is not limited thereto.

The mobile terminal 100 uses the case 150 made of a metal material as a radiation unit.

Specifically, when radiating electric waves, the mobile terminal 100 radiates electric waves through the radiation unit 134 of the antenna 130. However, most of the radiated electric waves are not directly radiated to the outside, but instead induce a coupling effect in the slot 160 formed in the case 150. Thereby, as illustrated in FIG. 1C, electric charges are induced in both sides of the slot 160. In the case 150, more particularly in the slot area, actual radiation occurs through the induced electric charges. That is, the case 150 performs a function of a radiation unit and radiates electric waves to the outside.

Although the case 150 is made of a metal, radiation of the antenna 130 is not blocked by the case 150. The case 150 is used as a radiation unit through the slot 160 formed in the case 150. Accordingly, rather than performing actual radiation to the outside, the radiation unit 134 operates as a feeder for inducing electric charges to both sides of the slot 160 of the case 150.

Further, in an exemplary implementation, the radiation unit 134 operating as a feeder and the case 150 operating as an actual radiation unit to the outside are not electrically connected. A method for inducing electric charges to the slot 160 of the case 150 using a coupling effect is used. Therefore, in the antenna structure, the radiation unit 134 operating as a feeder and the case 150 operating as an actual radiation unit are indirectly connected for feeding.

In this way, as the case 150 of the mobile terminal 100, which is entirely made of a metal, is used as an actual radiation unit, an effective performance of the antenna 130 may be secured.

Figure 3A:
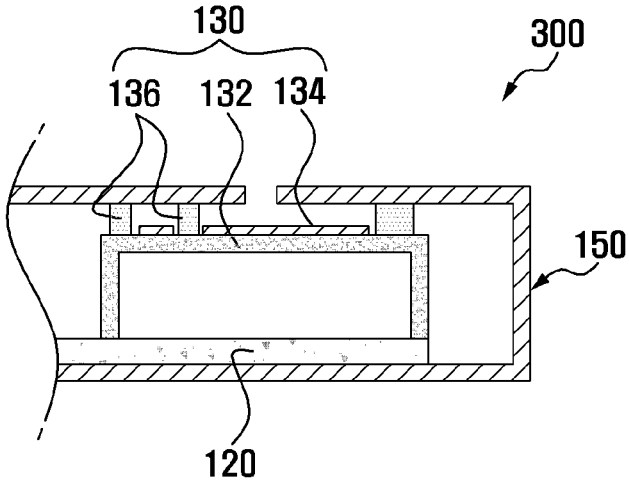
FIGS. 3A and 3B are cross-sectional views of an antenna portion of a mobile terminal according to exemplary embodiments of the present invention.
Figure 3B:
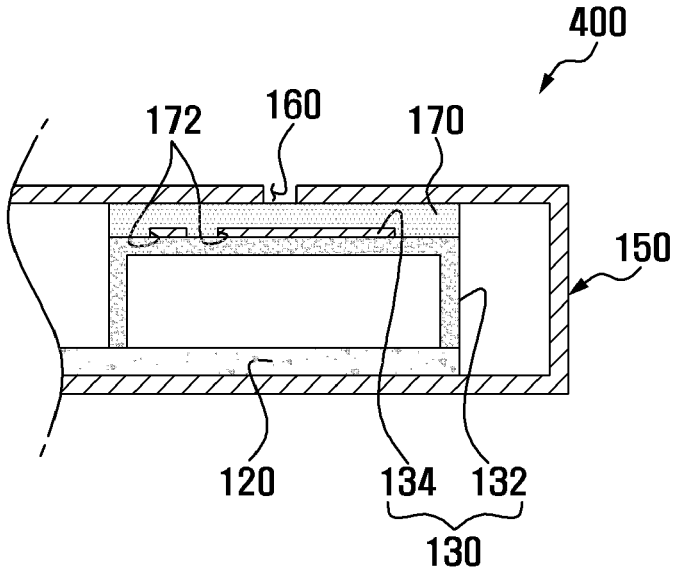

As described above, the radiation unit 134 and the slot area of the case 150 are formed very closely to each other in the mobile terminal 100. Thereby, the radiation unit 134 and the slot area of the case 150 have contact by an external pressure. Therefore, in order to prevent contact, a member for preventing a contact may be inserted between the radiation unit 134 and the slot area of the case 150. FIGS. 3A and 3B are cross-sectional views of an antenna portion of a mobile terminal according to exemplary embodiments of the present invention.

Referring to FIG. 3A, in an upper surface of the base 132 of the antenna 130 to which the radiation unit 134 is fastened, a plurality of support members 136 are formed in a mobile terminal 300. Each support member 136 is formed in a cylindrical shape and protrudes from the base 132 to a height greater than the height of the radiation unit 134. The end part of the support 136, which is opposite to the surface having contact with the base 132, contacts with an inner surface of the case 150. That is, the support member 136 is formed to protrude by a separation distance between an upper surface of the base 132 and the slot area of the case 150. Therefore, even if the slot area of the case 150 is pressed down by an external pressure, the support member 136 supports the case 150, thereby preventing the case 150 and the radiation unit 134 from contacting.

Referring to FIG. 3B, a dielectric plate 170 is interposed between the radiation unit 134 of the antenna 130 and a slot area of the case 150 in a mobile terminal 400. The dielectric plate 170 has the same area as that of an upper surface of the base 132 of the antenna 130. The thickness of the dielectric plate 170 forms a separation distance between the upper surface of the base 132 and the slot area of the case 150. Further, in a surface of the dielectric plate 170 having contact with the radiation unit 134, a groove 172 in which the radiation unit 134 is to be inserted into is formed according to a shape of the radiation unit 134.

The dielectric plate 170 is made of an electrical insulation material. Further, in an exemplary implementation, the dielectric plate 170 has the same area as the area of the upper surface of the base 132. However, the area of the dielectric plate 170 is not limited thereto. For example, the dielectric plate 170 may have the same form as the radiation unit 134 and may be fastened to an upper surface of the radiation unit 134, or the dielectric plate 170 may have a through hole into which the radiation unit 134 is inserted. That is, the dielectric plate 170 may be formed in various forms so that a coupling effect may occur between the slot area of the case 150 and the radiation unit 134.

When the dielectric plate 170 is interposed between the radiation unit 134 and the slot area of the case 150, even if the slot area of the case 150 is pressed down by an external pressure similarly to FIG. 3A, contact between the case 150 and the radiation unit 134 may be prevented. Further, because a coupling effect changes according to a material of the dielectric plate 170, the material of the dielectric plate 170 may be tuned to exhibit an appropriate coupling effect.

In an exemplary implementation, the dielectric plate 170 of FIG. 3B or the support member 136 of FIG. 3A formed separately from the case 150 is used. However, in another exemplary implementation, an inner wall of the case 150 may be coated with an insulation material in order to prevent an electrical contact.

Figure 4A:
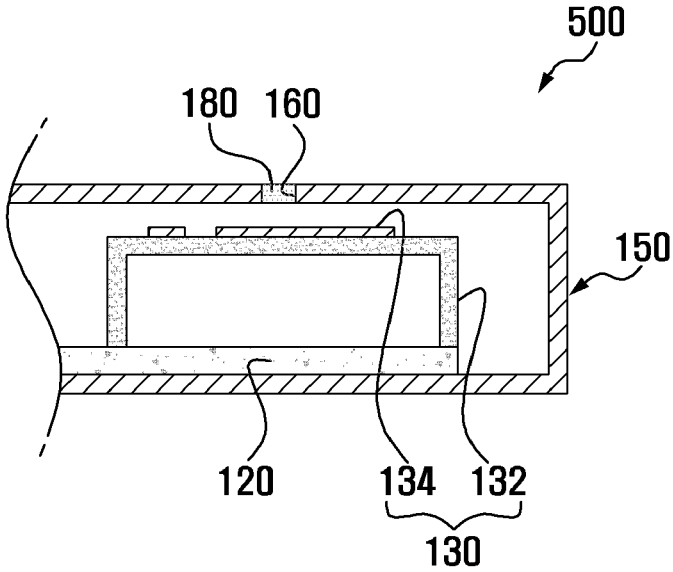
FIGS. 4A and 4B are cross-sectional views of an antenna portion of a mobile terminal according to exemplary embodiments of the present invention.
Figure 4B:
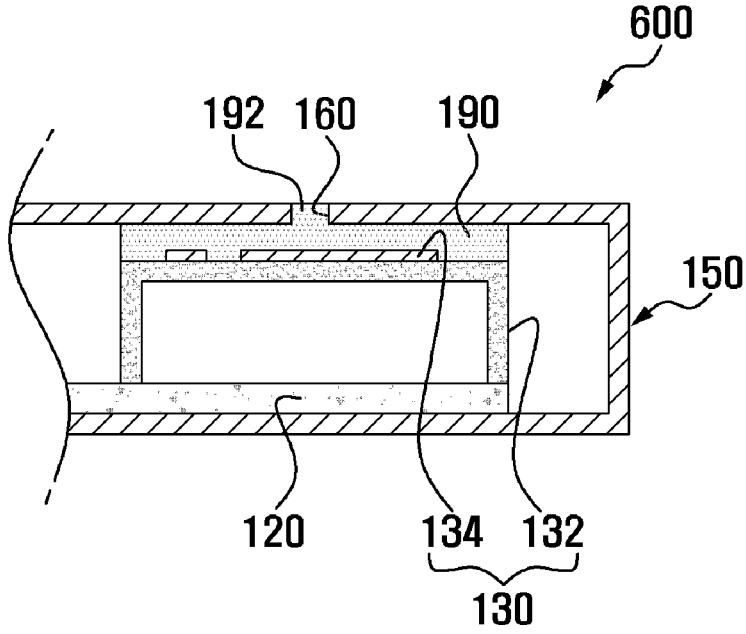

In FIGS. 3A and 3B, the slot 160 formed in the case 150 is empty. However, a separate member may be inserted into the slot 160. FIGS. 4A and 4B are cross-sectional views of an antenna portion of a mobile terminal in which a dielectric member is inserted into a slot according to exemplary embodiments of the present invention.

Referring to FIG. 4A, a dielectric member 180 is inserted into the slot 160 formed in the case 150 of a mobile terminal 500. The dielectric member 180 is made of the same material as the dielectric plate 170 of FIG. 3B, i.e., any material having electrical insulation.

FIG. 4B illustrates a mobile terminal 600 in which the dielectric member 180 illustrated in FIG. 4A and the dielectric plate 170 illustrated in FIG. 3B are integrally formed as one component. A dielectric plate 190 of FIG. 4B includes a protruding part 192 that protrudes from a surface of the dielectric plate 190 having contact with the case 150 into the slot 160 and that is formed in the same shape as the slot 160. The protruding part 192 may protrude from the dielectric plate 190 to a height equal to the thickness of the case 150, but may protrude more or less than the thickness of the case 150.

In an exemplary implementation, dust is prevented from entering through the slot 160 to inside of the mobile terminals 400, 500 and 600, as illustrated in FIGS. 3B, 4A and 4B, having the dielectric plate 170, dielectric member 180 and dielectric plate 190, respectively. Thereby, durability of the case 150 may be improved.

Hereinafter, the term "the mobile terminal 100" is used to refer to any of the mobile terminals 100 to 600.

In an exemplary implementation, the antenna 130 of the mobile terminal 100 having any of the above-described configurations exhibits a different performance according to a usage environment of the antenna 130 and to other constituent elements of the mobile terminal 100 having the antenna 130. Therefore, the antenna 130 should be appropriately tuned at the following tuning points in order to exhibit an optimum performance.

A shape and a thickness of the slot 160 formed in the case 150 may be used as a tuning point for the antenna 130. Further, a position and shape of the radiation unit 134 of the antenna 130 and a separation distance between the radiation unit 134 and the case 150 may be used as a tuning point for the antenna 130.

In an exemplary implementation, when the radiation unit 134 and the slot 160 are formed in the same direction, i.e., when the slot 160 is formed in a straight line parallel to a length direction of the radiation unit 134, as illustrated in FIG. 1B, an improved radiation performance was obtained. However, if a more improved radiation performance is obtained through various combinations of a shape of the radiation unit 134 and a shape of the slot 160, the radiation unit 134 and the slot 160 may be tuned with a shape corresponding thereto.

An antenna performance of the mobile terminal 100 is described hereinafter.

The mobile terminal 100 used for measuring an antenna performance has a slot shape illustrated in FIGS. 1A to 1C and 2 and has a dual mode antenna 130 for performing functions both of a CDMA antenna and a PCS antenna. Therefore, the mobile terminal 100 transmits and receives a wireless signal in both a CDMA frequency band and a PCS frequency band. Measured values thereof are illustrated in FIGS. 5A and 5B.

Figure 5A:
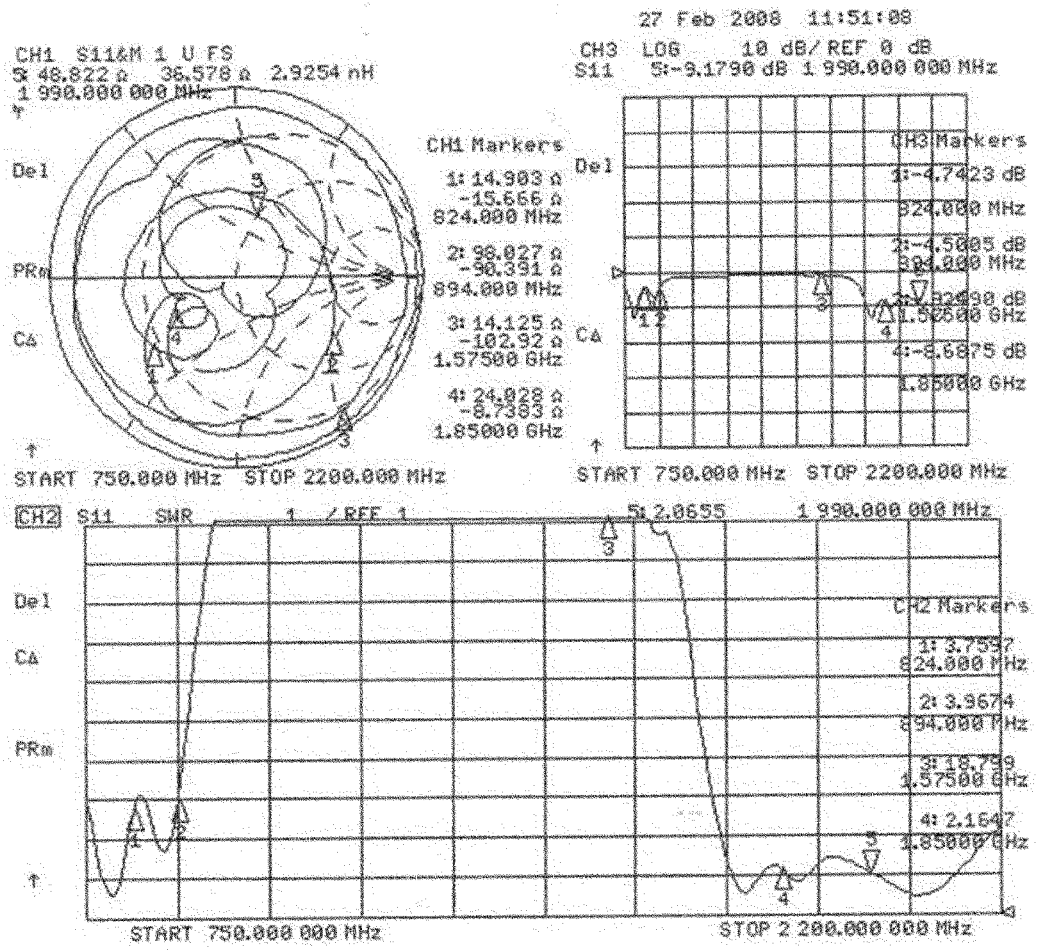
FIG. 5A is a graph illustrating a measured result of a Voltage Standing Wave Ratio (VSWR) of a mobile terminal according to an exemplary embodiment of the present invention.

FIG. 5A is a graph illustrating a measured result of a Voltage Standing Wave Ratio (VSWR) of the mobile terminal according to an exemplary embodiment of the present invention, and FIG. 5B is a table illustrating a passive gain on a frequency basis according to a measured result of a VSWR of the mobile terminal according to an exemplary embodiment of the present invention.

Referring to FIGS. 5A and 5B, the antenna 130 has a relatively low VSWR at point '1' (824 MHz) and point '2' (894 MHz), which form a CDMA frequency band, and has a low VSWR at point '4' (1850 MHz) and point '5' (1990 MHz), which form a PCS frequency band (see FIG. 5A).

More particularly, referring to FIG. 5B, in a range between point '4' (1850 MHz) and point '5' (1990 MHz), which is a PCS frequency band, a passive gain outputs an average value between −4.51 dBi and −5.94 dBi (see Ave. Gain). A passive gain of an antenna having a value of a range from −4 dBi to −5 dBi is generally available.

Figure 6:
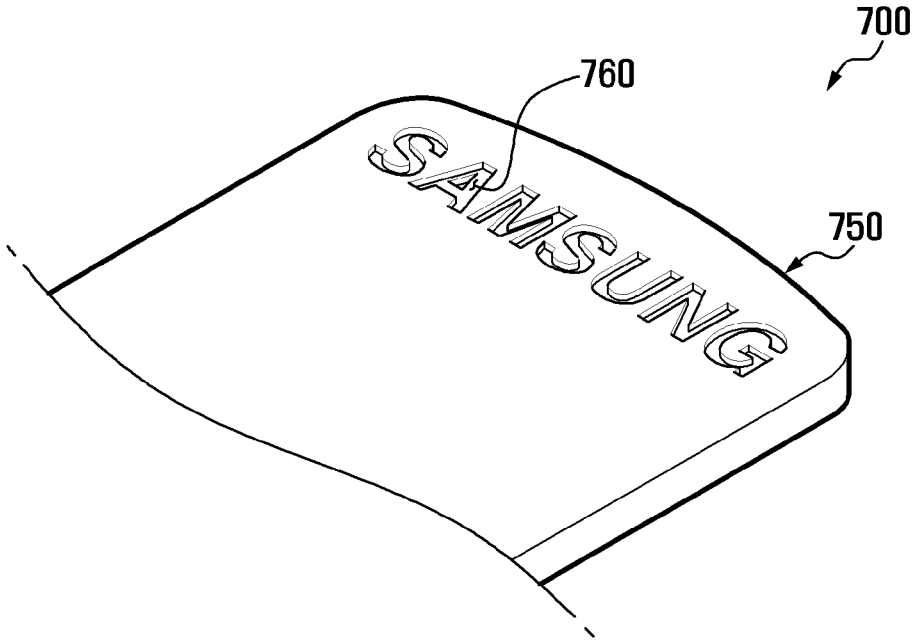
FIG. 6 is a partial perspective view of a mobile terminal having a slot shape according to an exemplary embodiment of the present invention.

FIG. 6 is a partial perspective view of a mobile terminal having a slot shape according to an exemplary embodiment of the present invention.

Referring to FIG. 6, a slot 760 of a mobile terminal 700 is formed in a character shape instead of a simple straight line, as described above. In FIG. 6, the slot 760 is formed in a case 750 to have characters, such as 'SAMSUNG'.

Figure 7A:
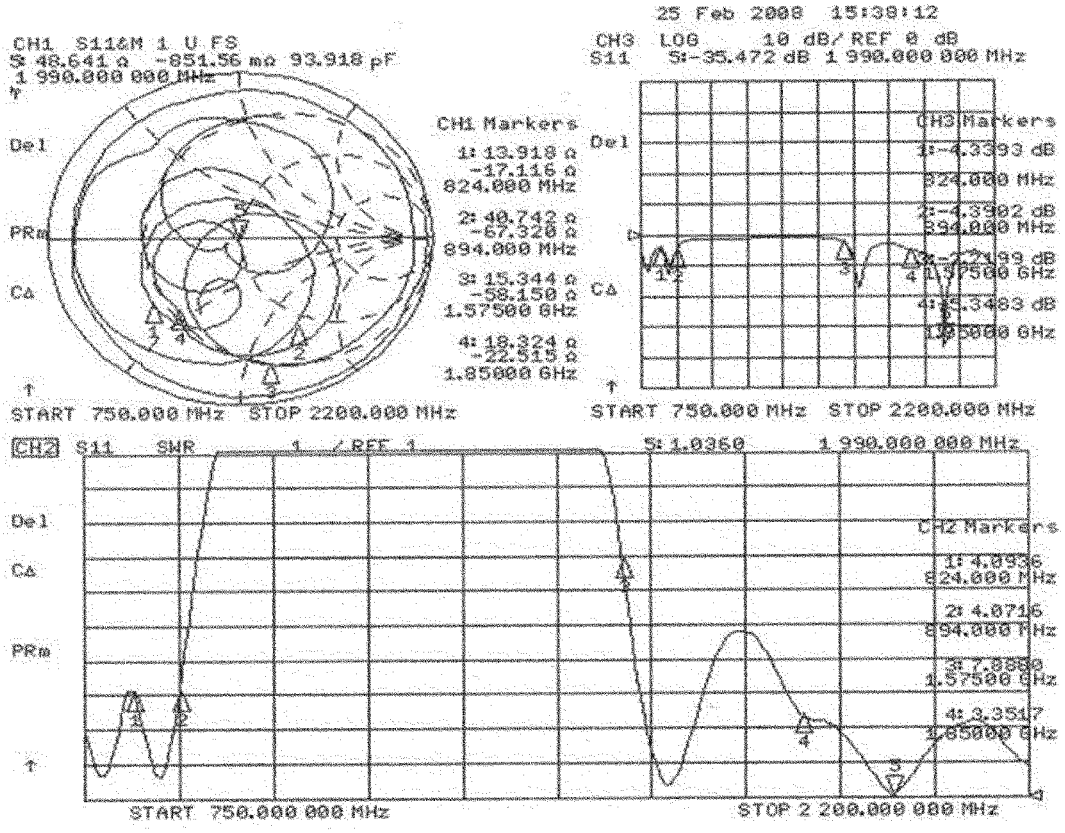
FIG. 7A is a graph illustrating a measured result of a VSWR of a mobile terminal according to an exemplary embodiment of the present invention.

Measured values of performance characteristics of the mobile terminal 700 according to an exemplary embodiment of the present invention are illustrate in FIGS. 7A and 7B.

FIG. 7A is a graph illustrating a measured result of a VSWR of a mobile terminal according to an exemplary embodiment of the present invention, and FIG. 7B is a table illustrating a passive gain on a frequency basis according to a measured result of a VSWR of a mobile terminal according to an exemplary embodiment of the present invention.

Similarly to the mobile terminal 100 illustrated in FIG. 1A, the mobile terminal 700 used for measuring the VSWR has a dual mode antenna 130 for performing functions both of a CDMA antenna and a PCS antenna. Therefore, the mobile terminal 700 may transmit and receive a wireless signal in both a CDMA frequency band and a PCS frequency band.

Referring to FIG. 7A, the mobile terminal 700 has measured values similar to those of the mobile terminal 100. That is, FIG. 7A illustrates a relatively low VSWR at point '1' (824 MHz) and point '2' (894 MHz), which form a CDMA frequency band, and has a low VSWR at point '4' (1850 MHz) and point '5' (1990 MHz), which form a PCS frequency band.

Referring to FIG. 7B, a passive gain outputs an average value between −4.38 dBi and −6.29 dBi in a range between point '4' (1850 MHz) and point '5' (1990 MHz), which is a PCS frequency band (see Ave. Gain).

The measurement value of the mobile terminal 700 represents a lower performance than the performance of the mobile terminal 100. However, the performance of the mobile terminal 700 is not significantly lower.

In the antenna structure of the mobile terminal according to an exemplary embodiment of the present invention, a slot may be formed in various shapes other than a single fixed shape, which is useful in a design aspect.

As described above, the antenna 130 of FIG. 1B is not limited to a communication antenna (for example, a CDMA antenna or a PCS antenna). Hereinafter, an example in which the antenna of the mobile terminal is a GPS reception antenna (GPS antenna) is described.

An exemplary embodiment of the present invention is described with reference to the mobile terminal 100 illustrated in FIG. 1B. A shape of a radiation unit of the GPS antenna may be formed differently from the shape of the communication antenna. However, in the present invention, because a shape of the radiation unit is not specifically limited, for convenience of description, the antenna 130 illustrated in FIG. 1B is assumed to be a GPS antenna.

Further, the mobile terminal 100 may have both a communication antenna and a GPS antenna. However, in an exemplary implementation, the present invention may be easily operated with the GPS antenna 130. Therefore, configuration of the communication antenna is omitted and the configuration of the GPS antenna 130 is described.

The mobile terminal 100 used for measurement has the GPS antenna 130 therein and has the slot shape illustrated in FIG. 1B in the case 150.

Figure 8A:
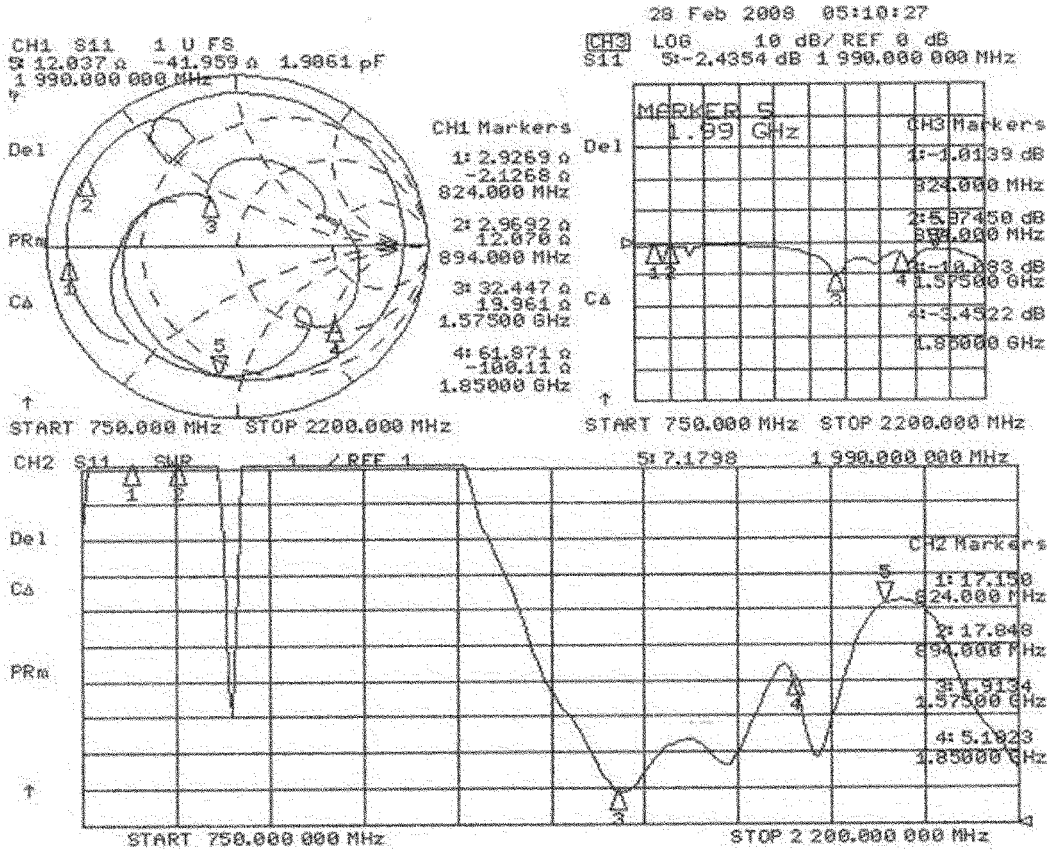
FIG. 8A is a graph illustrating a measured result of a VSWR of a mobile terminal having a GPS antenna according to an exemplary embodiment of the present invention.

FIG. 8A is a graph illustrating a measured result of a VSWR of the mobile terminal 100 having a GPS antenna according to an exemplary embodiment of the present invention, and FIG. 8B is a table illustrating a passive gain on a frequency basis according to a measured result of a VSWR of a mobile terminal having a GPS antenna according to an exemplary embodiment of the present invention.

Referring to FIG. 8A, the mobile terminal 100 has a very low VSWR in a range of 1570 MHz to 1580 MHz, which is a GPS frequency band. Specifically, the mobile terminal 100 has a very low VSWR (1.9134) at point '3', which is a frequency of 1575 MHz.

Referring to FIG. 8B, the mobile terminal 100 outputs an average value between −5.04 dBi to −5.10 dBi for GPS frequencies in a range of 1574 MHz to 1576 MHz (see Ave. Gain). The average value is almost the same value as the passive gain of a conventional GPS antenna. Thereby, the antenna structure according to an exemplary embodiment of the present invention is not limited to a communication antenna and other antennas may also be applied.

A mobile terminal having a metal case and an antenna structure according to exemplary embodiments of the present invention may be used. In general, when a metal case is used as an external shape of the mobile terminal, a radiation performance of the antenna is reduced or cannot be obtained. However, in an exemplary implementation, a slot is formed in a metal case, and the metal case is used as a radiation unit using the slot. Therefore, although the case of the mobile terminal is made of a metal, the antenna structure may be used. Further, the slot may be formed in various shapes. Therefore, the case of the mobile terminal may be easily designed in a metal material.

Exemplary embodiments of the present invention illustrate an antenna structure for a mobile terminal. However, the present invention is not limited thereto and may be applied to other appliances having an antenna for wireless communication and having an external case made of a metal.

Further, exemplary embodiments of the present exemplary invention illustrate a case where a slot is formed in a rear surface of the mobile terminal. However, the present invention is not limited thereto. For example, an antenna radiation unit may be installed in a side surface of the mobile terminal and a slot may be formed in a side surface of the case of the mobile terminal. Thus, the slot may be formed at various positions according to a position of the antenna radiation unit.

Further, exemplary embodiments of the present invention illustrate a case where one slot is formed for one antenna. However, when a plurality of antennas is installed within the mobile terminal, a plurality of slots corresponding to the antennas may be formed.

As described above, in a mobile terminal having a metal case and an antenna structure thereof, a slot is formed in a metal case and the metal case is used as a radiation unit using the slot. Thus, the case of the mobile terminal may be made of metal.

Further, in the mobile terminal, as the slot may be formed in various shapes, the case of the mobile terminal may be designed having various slot shapes.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An antenna structure comprising:

an antenna comprising a radiation unit for transmitting and for receiving electric waves;

a Printed Circuit Board (PCB) to which the antenna is mechanically coupled at one surface thereof and comprising a power supply unit electrically coupled to the radiation unit; and a case constructed comprising a metal material within which the PCB is disposed, wherein the case comprises at least one slot formed in a surface thereof opposite to the surface to which the PCB is mechanically coupled and adjacent to the radiation unit, and wherein the radiation unit is separated from the surface of the case in which the slot is formed by a distance determined for enabling a coupling effect between the radiation unit and the metal material in a vicinity of the slot in accordance with at least one predetermined frequency.

2. The antenna structure of claim 1, wherein the slot comprises a first portion formed as a straight line along a first direction of the radiation unit.

3. The antenna structure of claim 2, wherein the slot comprises a second portion formed as a straight line along a second direction of the radiation unit and having one end thereof connected to the first portion, the first direction being perpendicular to the second direction.

4. The antenna structure of claim 1, wherein the slot forms at least one of a character and a symbol.

5. The antenna structure of claim 1, further comprising a dielectric material interposed between the surface of the case, in which the slot is formed, and the radiation unit, a thickness of the dielectric material maintaining the distance between the radiation unit and the metal material.

6. The antenna structure of claim 1, wherein the case comprises a dielectric member formed to fill the slot.

7. The antenna structure of claim 1, wherein the antenna comprises one of a Code Division Multiple Access (CDMA) antenna, a Personal Communication Service (PCS) antenna, and a Global System for Mobile Communication (GSM) antenna.

8. The antenna structure of claim 1, wherein the antenna comprises one of a Global Positioning System (GPS) antenna, a Bluetooth antenna, and a wireless Local Area Network (LAN) antenna.

9. A mobile terminal, the terminal comprising:

an antenna comprising a radiation unit for transmitting and for receiving electric waves;

a Printed Circuit Board (PCB) to which the antenna is mechanically coupled at one surface thereof and comprising a power supply unit electrically coupled to the radiation unit; and a case constructed comprising a metal material within which the PCB is disposed, wherein the case comprises at least one slot formed in a surface thereof opposite to the surface to which the PCB is mechanically coupled and adjacent to the radiation unit, and wherein the radiation unit is separated from the surface of the case in which the slot is formed by a distance determined for enabling a coupling effect between the radiation unit and the metal material in a vicinity of the slot in accordance with at least one predetermined frequency.

10. The terminal of claim 9, wherein the slot comprises a first portion formed as a straight line along a first direction of the radiation unit.

11. The terminal of claim 10, wherein the slot comprises a second portion formed as a straight line along a second direction of the radiation unit and having one end connected to the first portion, the first direction being perpendicular to the second direction.

12. The terminal of claim 9, wherein the slot forms at least one of a character and a symbol.

13. The terminal of claim 9, further comprising a dielectric material interposed between the surface of the case, in which the slot is formed, and the radiation unit, a thickness of the dielectric material maintaining the distance between the radiation unit and the metal material.

14. The terminal of claim 9, wherein the case comprises a dielectric member formed to fill the slot.

15. The terminal of claim 9, wherein the antenna one of a Code Division Multiple Access (CDMA) antenna, a Personal Communication Service (PCS) antenna, a Global System for Mobile Communication (GSM) antenna, a Global Positioning System (GPS) antenna, a Bluetooth antenna, and a wireless Local Area Network (LAN) antenna.

* * * * *